US010266380B2

(12) United States Patent
Fickert

(10) Patent No.: US 10,266,380 B2
(45) Date of Patent: Apr. 23, 2019

(54) TREATMENT HEAD AND CONTAINER TREATMENT MACHINE HAVING A TREATMENT HEAD

(71) Applicant: KHS GmbH, Dortmund (DE)

(72) Inventor: Hilmar Fickert, Kriftel (DE)

(73) Assignee: KHS GmbH, Dortmund (DE)

( * ) Notice: Subject to any disclaimer, the term of this patent is extended or adjusted under 35 U.S.C. 154(b) by 113 days.

(21) Appl. No.: 15/308,471

(22) PCT Filed: Apr. 21, 2015

(86) PCT No.: PCT/EP2015/058545
§ 371 (c)(1),
(2) Date: Nov. 2, 2016

(87) PCT Pub. No.: WO2015/169579
PCT Pub. Date: Nov. 12, 2015

(65) Prior Publication Data

US 2017/0088408 A1 Mar. 30, 2017

(30) Foreign Application Priority Data

May 5, 2014 (DE) ..... 10 2014 106 203

(51) Int. Cl.
*B67C 3/34* (2006.01)
*B67D 1/08* (2006.01)

(52) U.S. Cl.
CPC ..... *B67C 3/34* (2013.01); *B67D 1/0805* (2013.01)

(58) Field of Classification Search
CPC ..... B67C 3/34; D67D 1/0805; B08B 9/0813
USPC ..... 141/18
See application file for complete search history.

(56) References Cited

U.S. PATENT DOCUMENTS 2,676,611 A * 4/1954 Page ..... F16K 17/10 137/456
2,918,083 A * 12/1959 Clark, Jr. ..... F16K 15/026 137/515.5
2005/0279777 A1 12/2005 Taguchi et al.

FOREIGN PATENT DOCUMENTS

| | | |
|---|---|---|
| DE | 30 14 746 | 10/1981 |
| DE | 31 01 06 | 8/1982 |
| DE | 10 2005 031 573 | 1/2007 |
| EP | 1 741 665 | 1/2007 |
| GB | 1 115 223 | 5/1968 |

* cited by examiner

*Primary Examiner* — Timothy L Maust
*Assistant Examiner* — James R Hakomaki
(74) *Attorney, Agent, or Firm* — Occhiuti & Rohlicek LLP

(57) ABSTRACT

A treatment head for filling a container that has a valve arrangement having an external valve-part and a fastening region includes a housing, a plunger, first and second fluid-ducts, a seal, and a shielding section. The plunger is held so as to be displaced for opening said valve arrangement. The first fluid-duct feeds liquid into said container, and the second fluid-duct provides a path for discharging fluid from said container. The seal bears against the external valve-part. The shielding section shields at least the fastening region from fluid carried in the first fluid-duct.

19 Claims, 3 Drawing Sheets

TREATMENT HEAD AND CONTAINER TREATMENT MACHINE HAVING A TREATMENT HEAD

RELATED APPLICATIONS

This is the national stage under 35 USC 371 of PCT/EP2015/058545, filed on Apr. 21, 2015, which claims the benefit of the May 5, 2014 priority date of German application DE 10-2014-106-203.5, the contents of which are herein incorporated by reference.

FIELD OF INVENTION

The invention relates to containers for drinks, and in particular, to a treatment head for such containers.

BACKGROUND

It is known that liquid products, for example beer, soft drinks, fruit juices or similar products, are filled and stored in large-volume containers, such as drums or kegs. Kegs usually have a valve arrangement through which the keg is filled with the liquid product and through the liquid product is drawn from the container for consumption via a tap system that is connected to this valve arrangement.

Valve arrangements of this kind are introduced and fastened to a valve mounting-section of the container wall inside the keg. In some known valve arrangements, a circlip attaches an external valve part to this valve mounting-section of the container by a circlip. In other known valve arrangements, a male thread provided on an external valve part screws into the valve mounting-section.

A difficulty with such valve arrangements, which are also known as fittings, is that mold can form inside the intricate component structures of the valve arrangements as the container rotates from the filling plant, to the customer, and back to the filling plant, i.e. during the multiple use of the container.

A major cause of this problem is that, in the region of the valve arrangement and, in particular, in the transitional region between the external valve part and the valve mounting-section of the container, there are many intricate structures. These include such structures as openings, gaps or undercuts. These all come into contact with product as the container is being filled.

Given the intricate configuration of these openings and gaps or undercuts, it is very difficult to subsequently remove or rinse away any residual product, even using intensive rinsing operations or similar cleaning methods. These product residues can spoil during the subsequent storage of the container and cause mold to form depending on the storage conditions.

SUMMARY

An object of the invention is to provide a treatment head that facilitates container treatment and that promotes hygiene.

According to an initial aspect, the invention features a treatment head for treating, and in particular filling, a container having a valve arrangement. The treatment head includes a plunger that is held displaceably in a treatment-head housing and used for opening the valve arrangement of the container. Inside the treatment head are provided a first fluid-duct for feeding a liquid fluid into the container, and a second fluid-duct for discharging a liquid or gaseous medium from the container, with the treatment head comprising a seal configured to bear against an external valve part. The treatment head also includes a shielding section that is configured so as to shield at least a fastening section of the valve arrangement from the fluid that is carried in the first fluid-duct.

During container treatment, the shielding section prevents product or cleaning/rinsing fluid from penetrating into the fastening section within whose region the valve arrangement is held in a valve mounting-section of the container. In other words, the intricate structures between the valve mounting-section of the container and the external valve part are protected from ingress of fluid. This suppresses mold growth during subsequent storage of the container.

In one embodiment, the shielding section is sheath-like in configuration, at least in sections. For example, the shielding section is arranged concentrically about the plunger, surrounding it peripherally at a distance. This sheath-like shielding section forms, with its wall, a barrier against the ingress of the fluid into the fastening region. The length of the sheath-like shielding section is selected in such a way that it straddles the region between the external valve part and a treatment-head housing-section, and in particular, the region of the fastening section.

In one embodiment, the valve arrangement includes a cup-like recessed region bounded by at least one circumferential valve wall section, with the shielding section being configured to shield and/or seal off the valve wall section from the fluid carried in the first fluid-duct. The valve wall section is, for example, part of the external valve part by way of which the valve arrangement is fixed in the valve mounting-section of the container. In particular, the valve arrangement can be held on the valve mounting-section of the container by way of or in the region of the valve wall section. Shielding the valve wall section ensures that openings or gaps that are configured in it, and in particular, openings and gaps that occur when the valve arrangement is fastened in the valve mounting-section of the container, are kept fluid-free. This inhibits mold formation.

In a further embodiment the shielding section is matched to the form of the cup-like recessed region of the valve arrangement. This ensures that when the container is set down on the treatment head or the plunger is pushed into the valve arrangement to open the latter, the seal and the shielding section can be introduced into the cup-like recessed region, specifically in such a way that a fluid-tight shielding of the fastening region is achieved when the seal of the treatment head is fitted to the external valve part.

In a further embodiment, when the valve arrangement is open, the shielding section shields the first fluid-duct radially to the exterior section by section between a treatment-head housing-section that surrounds the plunger at a distance and the external valve part. The shielding section extends, with its longitudinal direction, parallel to the longitudinal axis of the plunger, and, in the region of its free end, which faces the valve arrangement, it lies fluid-tight up against the external valve part through the seal. In addition, either the outside of the shielding section forms a sealing face that lies against the treatment-head housing-section, or a seal is provided that creates a fluid-tight connection between the outside of the shielding section and the treatment-head housing-section. The fluid-tight connection at both ends ensures that the fastening region is isolated in a fluid-tight manner from the first fluid-duct and that the shielding section forms a radially outward boundary of the first fluid-duct in this fastening region.

The seal, which is configured to bear against the external valve part, is preferably provided on or in the region of the shielding section. The seal is provided, in particular, on the end face of the shielding section so that it seals off the first fluid-duct to the exterior and effectively prevents the fluid from escaping even into the fastening region.

In another embodiment, the shielding section is formed by a seal section that stands away from the seal. The seal section can be formed from an elastomer, for example a rubber. Alternatively, the shielding section may also be formed by a non-deformable material, such as plastic or metal, with the fluid-tight connection to the treatment-head housing-section being created by way of a seal or sealing lip. The seal and the shielding section are formed, preferably, by a one-piece sealing element. For example, a sealing collar can be provided. Such a sealing collar, on a frontal first sealing collar section, performs the sealing function of the seal and includes a sleeve-shaped second sealing collar section that stands away from the first sealing collar section and that performs the previously described shielding function of the shielding section.

In another embodiment, the shielding section, and preferably also the seal that comes to bear against the external valve part, is held in an undisplaceable manner on the treatment head, in particular on the treatment-head housing. The seal can be held on the treatment head by way of the shielding section, for example. When the container is attached to the treatment head, the seal comes to bear up against the external valve part irrespective of the position of the plunger. The shielding section can be disposed at the end, which lies opposite the seal or on the outer periphery in the region of the end that lies opposite the seal and in sealed position up against a treatment housing section. Or it can be permanently attached to it. The shielding section can also be part of a section of the treatment housing.

In another embodiment, the shielding section is held on the treatment-head housing in a displaceable manner. Thus, for example, a displacement of the shielding section or of a seal provided on the end face thereof can be effected through the motion of the plunger. The shielding element can, for example, be pre-tensioned by the action of the force of at least one spring. It is preferable for both the shielding section and the seal to be held on the plunger. As a result, during the process of opening the valve arrangement, the shielding element, together with the seal, is pushed out of the treatment-head housing and brought to bear against this valve arrangement such that the fastening region is protected from ingress of product.

According to one embodiment, when the valve arrangement is open, the first fluid-duct is formed in sections between the plunger and the shielding section. For example, the first fluid-duct runs along the outside of the plunger, for example in a plurality of fluid duct branches distributed around the periphery. The shielding section is provided concentrically around, and at a distance away from, the plunger so that the first fluid-duct is bounded radially by the plunger on the inside and by the shielding section on the outside.

Preferably, when the valve arrangement is open, the shielding section lies against the external valve part in a fluid-tight manner by way of the seal and, at a region lying at a distance away from the seal, the shielding section lies in a fluid-tight manner against a treatment-head housing-section or is attached to the latter in a fluid-tight manner. This configuration ensures that the first fluid-duct is isolated by the shielding section radially to the exterior in a fluid-tight manner from the fastening region of the valve arrangement or from a valve wall section formed on the external valve part, so as to prevent ingress of the liquid product into this fastening region.

Preferably, the shielding section surrounds the plunger sheath-like in sections, with the axial length of the sheath-like shielding section being such that, with one end face, it lies sealed off against the valve arrangement, and in a region lying at a distance away from said end face, it lies externally against a treatment-head housing-section, for example a contact face that runs ring-like around the shielding section. In this way the first fluid-duct can be sealed off radially to the exterior despite the shielding section being displaceable relative to the treatment-head housing-section.

According to a further aspect, the invention relates to a container treatment machine for treating, in particular for filling, containers that have a valve arrangement, and doing so with the use of at least one treatment head that is configured according to the embodiments described above.

In another aspect, the invention features a treatment head for filling a container that has a valve arrangement having an external valve-part and a fastening region includes a housing, a plunger, first and second fluid-ducts, a seal, and a shielding section. The plunger is held so as to be displaced for opening said valve arrangement. The first fluid-duct feeds liquid into said container, and the second fluid-duct provides a path for discharging fluid from said container. The seal bears against the external valve-part. The shielding section shields at least the fastening region from fluid carried in the first fluid-duct.

As used herein, the term "containers" refers to drums or kegs for the holding and storage of liquid products, in particular drinks. Container-treatment machines, as used herein, include any machines with which container treatment can be carried out, for example filling machines, cleaning machines, etc.

As used herein, "container treatment" is understood to mean all container treatment methods, in particular filling, cleaning, rinsing, etc.

As used herein, a "treatment head" is understood to mean all coupling devices for connecting a container that is to be treated with the treatment machine, and in particular, filling heads, cleaning heads, or rinsing heads.

As used herein, terms such as "substantially" or "around" mean variations from an exact value by ±10%, preferably by ±5% and/or variations in the form of changes that insignificant to function.

Further embodiments, advantages and possible applications of the invention arise out of the following description of embodiments and out of the figures. All of the described and/or pictorially represented attributes whether alone or in any desired combination are fundamentally the subject matter of the invention independently of their synopsis in the claims or a retroactive application thereof. The content of the claims is also made an integral part of the description.

BRIEF DESCRIPTION OF THE FIGURES

The invention is explained in detail below through the use of different examples with reference to the figures, in which.

DETAILED DESCRIPTION

Figure 1:
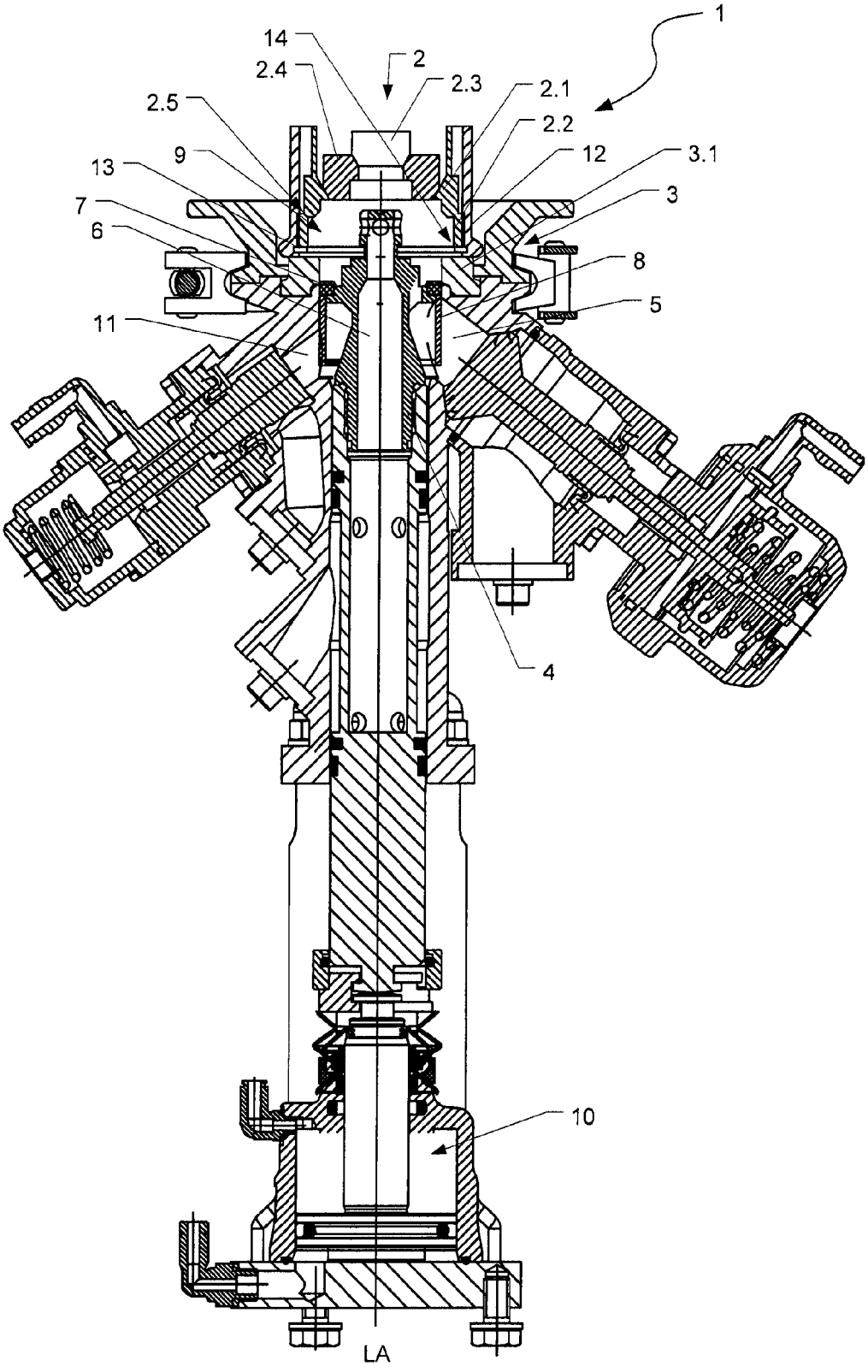
FIG. 1 shows a treatment head in position against a valve arrangement of a container in the closed position.

FIG. 1 shows a treatment head 1 having a treatment-head housing 3 that bears against a valve arrangement 2 of a container by way of a treatment-head housing-section 3.1, including for example in the form of a seal made from EPDM rubber. Usually, the container is a keg and a keg fitting forms the valve arrangement 2.

The illustrated valve arrangement 2 has cup-like recess region 9 bounded by at least one circumferential valve wall section 2.2, a first valve-body 2.3, and a second valve-body 2.4. When the valve arrangement 2 is closed, the first valve-body 2.3 lies sealed against an opening in the second valve-body 2.4. In addition, the second valve-body 2.4 lies sealed against a valve seat for a valve-arrangement section 2.1 that forms the second valve-body 2.4. As a result, the first and second valve-bodies 2.3, 2.4 seal the valve arrangement 2 in a fluid-tight manner.

In the illustrated embodiment, the valve-arrangement section 2.1 is an annular element of the valve arrangement 2. The valve-arrangement section 2.1 forms an external valve part 2.5 by way of which the valve arrangement 2 fastens to a valve mounting-section 12 of the container. In some embodiments, the valve-arrangement section 2.1 is a conical section that lies radially inside on an annular or sheath-like external valve part 2.5.

Figure 2:
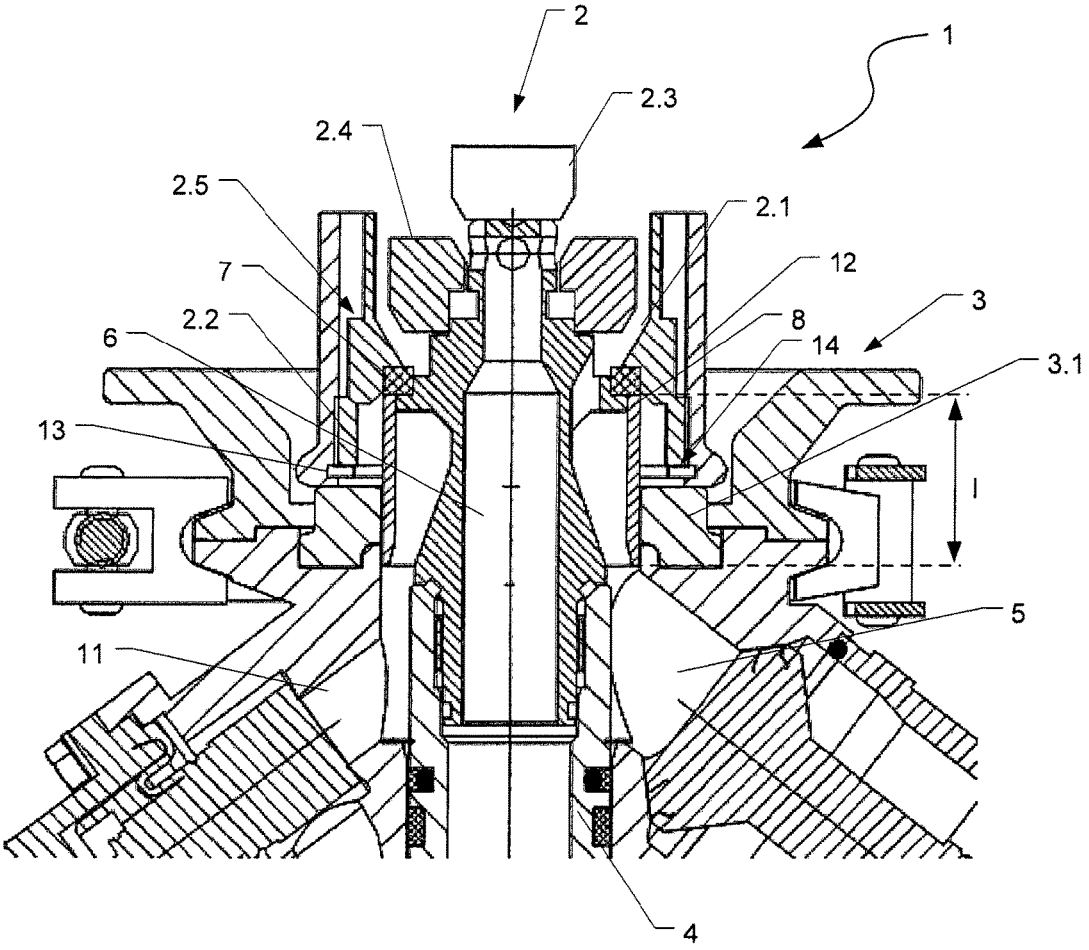
FIG. 2 shows a cutaway view of the treatment head of FIG. 1 in contact with a valve arrangement of a container in an open position.

The treatment head 1 includes a plunger 4 that is held in the treatment-head housing 3 such that an actuator 10 can displace it along a treatment head longitudinal axis LA. The actuator 10 displaces the plunger 4 from a retracted position, as shown in FIG. 1, to an extended position, as shown in FIG. 2. On its front free-end, which faces the valve arrangement 2, the plunger 4 is formed in such a way that when its free end pushes into the valve arrangement 2, both the first valve-body 2.3 and the second valve-body 2.4 lift off their respective valve seats, thereby opening two separate fluid-paths in the valve arrangement 2.

The treatment head 1 includes first and second fluid-ducts 5, 6. The first fluid-duct 5 provides a way to feed liquid product into the container. The second fluid-duct 6 provides a path for either drawing return gas from the container during filling or carrying away a cleaning or rinsing fluid after a cleaning or rinsing process. In the illustrated embodiment, the first fluid-duct 5 is configured peripherally about the plunger 4, while the second fluid-duct 6 runs, in some sections at least, inside the plunger 4.

In some embodiments, the treatment head 1 also has a third fluid duct 11 for introducing a propellant gas or gaseous medium into the container's interior, thus generating a positive pressure to pre-tension the drink. This pre-tensioning permits the drink to be drawn off by, for example, a tap system. Alternatively, the third fluid duct 11 can be one that draws off splashed liquid so as to effectively prevent contamination from splashing liquid when detaching the keg from the treatment head 1.

The treatment head 1 also has a seal 7. In some embodiments, the seal 7 is on the plunger 4. In other embodiments, the seal 7 is on the treatment-head housing 3. When a container is positioned on the treatment head 1, or when the plunger 4 is advanced against a contact section provided on the valve arrangement 2, the contact section being provided, for example, on an external valve part 2.5 and formed by a step in the external valve part 2.5, the seal 7 comes into contact and seals off the first fluid-duct 5 peripherally from the exterior.

The valve arrangement 2 that is shown in FIGS. 1 and 2 is introduced into a flange-like valve mounting-section 12 of the container. In the illustrated embodiment, a circlip 13 holds the valve arrangement 2 on a valve mounting-section 12. Some valve arrangements 2 and/or keg fittings have a male thread on their outer periphery by way of which the keg fitting can be screwed into a female thread provided in valve mounting-section 12.

A shielding section 8 prevents ingress of fluid into the fastening region 14 between the outer wall of the valve arrangement 2 and the valve mounting-section 12, or in the region of the circlip 13. The shielding section 8 separates or shields at least the first fluid-duct 5 from the fastening region.

In the illustrated embodiment, the shielding section 8 is a sheath that surrounds the outside of the plunger 4 at a distance away from it. The shielding section 8 can be arranged, for example, as a tube-like sleeve on the plunger 4. In such cases, the shielding section 8 is guided with the plunger 4 in the treatment-head housing 3 so as to be displaceable. The longitudinal axis of the shielding section 8 is preferably aligned parallel to a longitudinal axis LA of the plunger 4. The seal 7, which is preferably annular, is provided at the frontal end face of the shielding section 8, i.e. the end that faces the valve arrangement 2.

The shielding section 8 can be formed from any inherently stable material, such as steel or plastic, or also from a flexible material, for example an elastomer.

In some embodiments, the shielding section 8 and the seal 7 are integral with each other. In some such cases, a single sealing collar forms both the seal 7 and the shielding section 8.

Alternatively, the shielding section 8 can be part of the plunger 4 and the seal 7 can be disposed on the shielding section 8. In some embodiments, the shielding section 8 forms a sheath around the plunger 4. In other embodiments, the shielding section 8 and the plunger 4 form one piece.

FIG. 2 shows the treatment head 1 and the valve arrangement 2 with the plunger 4 having been positioned in an advanced position so that the valve arrangement 2 is opened. The forward free end of plunger 4 is stepped such that the first valve-body 2.3 and the second valve-body 2.4 are lifted off their respective valve seats. This simultaneously forms an opened and a further duct. The opened duct connects to the first fluid-duct 5 for the feeding of the liquid product. The further duct connects to the second fluid-duct 6 for discharging return gas and/or cleaning or rinsing fluid As the plunger 4 pushes forward, it displaces the shielding section 8 that is disposed on it. It does so in such a way that the shielding section shields a fastening region 14 in a fluid tight manner. This fastening region 14 is one in which the valve arrangement 2 is attached to the containers' valve mounting-section 12, for example by way of the external valve part 2.5.

The shielding section 8 has an axial length I such that, when the treatment head 1 couples to the container, and when the valve arrangement 2 opens as a result of the advancing plunger 4, fluid-tight connections form with the external valve part 2.5 and with the treatment-head housing 3. In particular, the fluid tight connection forms with the treatment-head housing section 3.1 that is formed by the free end of the shielding section 8 that faces away from the seal 7.

The treatment-head housing section 3.1 includes a sealing face that faces plunger 4 and that runs concentrically relative to its longitudinal axis LA. The sealing face, together with the shielding section 8, and in particular the outer peripheral surface of that the shielding section, effectively shields the fastening region 14 against fluid ingress. If the treatment-head housing-section 3.1 is made of an elastomer, the fluid-tight connection between the outside of the shielding section 8 and the treatment housing section 3.1 can be brought about by abutting the shielding section 8 against the treatment-head housing-section 3.1. Otherwise, abutting against a ring seal or a sealing lip can bring about the fluid-tight connection.

As shown in FIG. 2, the shielding section 8 can also seal the fastening region 14 from the first fluid-duct 5. In the region of the shielding section 8, the first fluid-duct 5 runs between the plunger's outer wall and the shielding section's inner wall. As a result, the shielding section 8 bounds the first fluid-duct 5 on the outside. This prevents fluid ingress into the fastening region 14. Meanwhile, the seal between the shielding section 8 and the treatment-head housing-section 3.1 and the valve arrangement 2 effectively prevents fluid carried by the first fluid-duct 5 from escaping outside in the direction of the fastening region 14.

Figure 3:
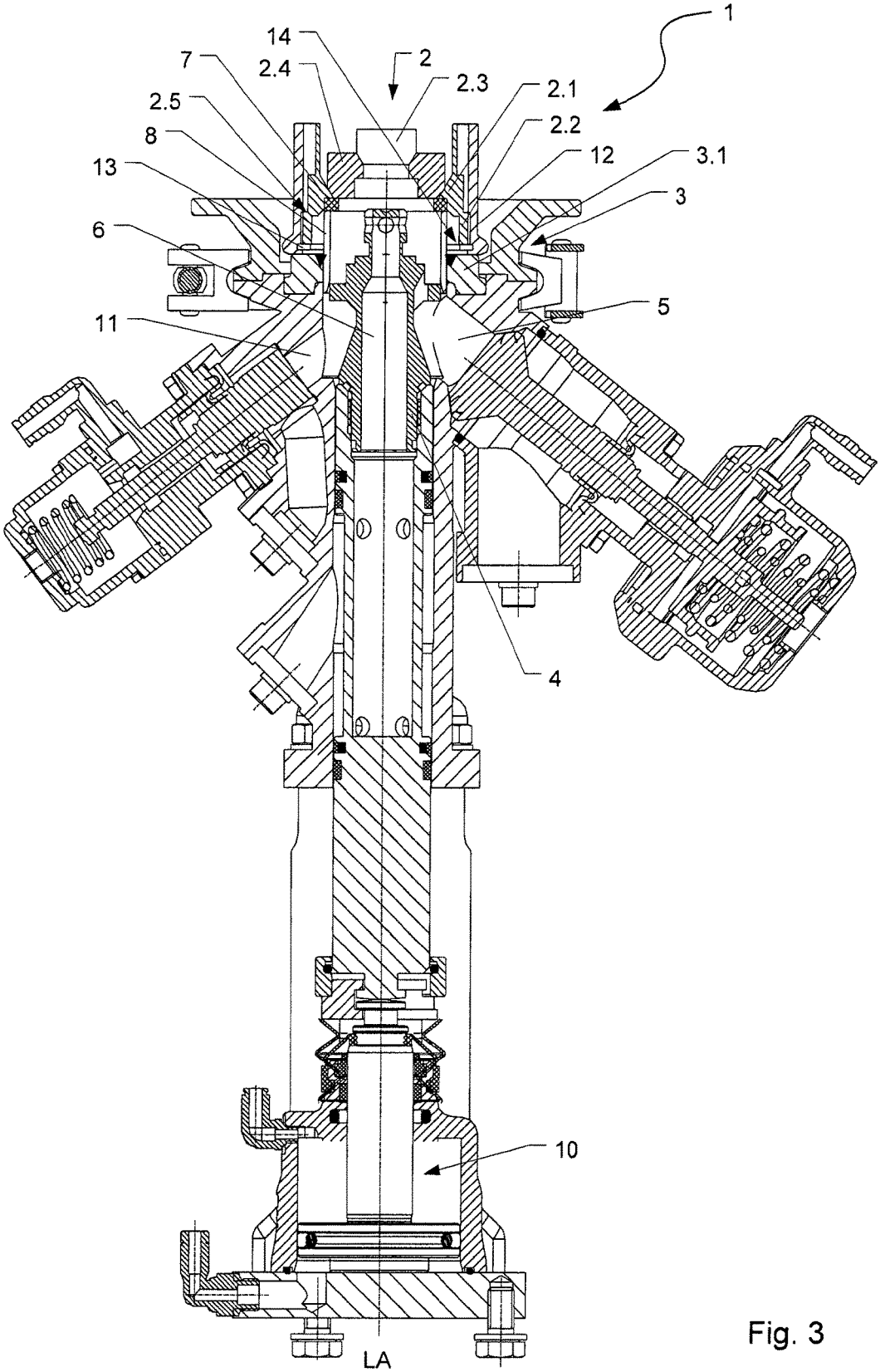
FIG. 3 shows another treatment head in position against a valve arrangement of a container in the closed position.

FIG. 3 shows a closed valve arrangement 2 mounted on a second embodiment of a treatment head 1. Only the differences between this treatment head 1 and the embodiment described above are presented below. Otherwise the statements made above also apply to this embodiment.

The main difference between the treatment head 1 in FIG. 3 and the embodiment described in connection with FIGS. 1 and 2 is that it is no longer the plunger 4 that holds the shielding section 8 and/or the seal 7. Instead, it is the treatment-head housing 3 that does so.

In the illustrated embodiment, a sheath-like shielding section 8 is held on the treatment-head housing-section 3.1. The treatment head housing section 3.1 can again be a section of the treatment-head housing 3 that forms a ring that surrounds the plunger 4. The figure shows a seal 7 on the end face of the shielding section 8 that faces away from the treatment-head housing 3. This seals the first fluid-duct 5 from the external valve part 2.5.

Regardless of the plunger's position, as soon as the container and the treatment head 1 make contact, the seal 7 forms a fluid-tight connection between the external valve part 2.5 and the treatment head 1. In addition, the shielding section 8 attaches to the treatment-head housing-section 3.1 in a way that achieves a fluid-tight connection between the shielding section 8 and the treatment housing section 3.1 on the side of the shielding section 8 that faces away from the seal 7. This prevents ingress of liquid product into the fastening region 14 during filling. As a result, the various intricate structures contained therein, which are difficult to clean, never come into contact with liquid product that may promote mold growth.

In an alternative embodiment, the shielding section 8 together with the seal 7 are held moveably on the treatment-head housing 3.

In some embodiments, it is useful to have a mechanism that extends the shielding section 8 out of the treatment-head housing 3 and towards the valve arrangement 2. Such a mechanism can be moved, for example, by advancing the plunger 4 towards the external valve part 2.5. This movement causes a fluid-tight connection by pressing the seal 7 against the external valve part 2.5, or a fluid-tight connection between the outside of the shielding section 8 and the treatment-head housing-section 3.1.

In some embodiments, one or more springs press the shielding section 8 and the seal 8 against the external valve part. This creates a spring-loaded fluid-tight connection between the external valve part 2.5 and the shielding section 8.

Having described the invention, and a preferred embodiment thereof, what is claimed as new, and secured by Letters Patent is:

1. An apparatus comprising a treatment head for container-filling through a valve arrangement that comprises an external valve-part, a fastening region, a cup-like recessed region, and at least one circumferential valve-wall section, wherein said cup-like recessed region is bounded by said at least one circumferential valve-wall section, wherein said treatment head comprises a housing, a plunger that, during container-filling, is held so as to be displaced for opening said valve arrangement, a first fluid-duct that feeds fluid through said valve arrangement, a second fluid-duct that provides a path for discharging fluid out through said valve arrangement, a seal that is configured to bear against said external valve-part of said valve arrangement, and a shielding section that is configured to shield said fastening region and said at least one valve-wall section from said fluid carried in said first fluid-duct, and wherein, in the region of said shielding section, said first fluid-duct runs between an outer wall of said plunger and an inner wall of said shielding section, whereby said first fluid-duct is bounded on an outside thereof by said shielding section, thereby preventing ingress of fed fluid into said fastening region.

2. The apparatus of claim 1, wherein at least a section of said shielding section forms a sheath that surrounds said plunger and is at a distance away from said plunger.

3. The apparatus of claim 1, wherein said shielding section conforms to said cup-like recessed region.

4. The apparatus of claim 1, wherein, when said valve arrangement is opened, said shielding section shields said first fluid-duct in sections radially outwards between a section of said housing, wherein said section of said housing surrounds said plunger at a distance and said external valve-part.

5. The apparatus of claim 1, wherein said seal is provided on said shielding section.

6. The apparatus of claim 1, wherein said treatment head further comprises a seal section standing away from said seal, wherein said seal section forms said shielding section.

7. The apparatus of claim 1, wherein said treatment head further comprises a one-piece seal element, wherein said one-piece seal element forms said seal and said shielding section.

8. The apparatus of claim 1, wherein said shielding section is held in a non-displaceable manner on said treatment head.

9. The apparatus of claim 1, wherein said shielding section is held in a non-displaceable manner on said housing.

10. The apparatus of claim 1, wherein said shielding section is held on said plunger.

11. The apparatus of claim 1, wherein said first fluid-duct comprises a section that is between said plunger and said shielding section when said valve arrangement is open.

12. The apparatus of claim 1, wherein, when said valve arrangement is open, said shielding section bears in a fluid-tight manner up against said external valve-part by way of said seal, which is provided on said shielding section, and wherein, at a region lying at a distance away from said seal, said shielding section bears in a fluid-tight manner up against a section of said housing in a fluid-tight manner.

13. The apparatus of claim 1, wherein said shielding section bears in a fluid-tight manner up against said external valve-part by way of said seal when said valve arrangement is open, said seal having been provided on said shielding section, and wherein a section of said housing and said shielding section connect to each other at a region lying at a distance away from said seal in a fluid-tight manner.

14. The apparatus of claim 1, wherein said shielding section defines a sheath that surrounds said at least a section of said plunger and is at a distance away from said plunger.

15. The apparatus of claim 1, wherein said fastening region is a region in which the valve arrangement is attached to a valve mounting section by way of an external valve-part.

16. The apparatus of claim 1, wherein there exists sealing contact between said shielding section and said valve arrangement.

17. The apparatus of claim 1, wherein said shielding section is held by said housing.

18. The apparatus of claim 1, wherein said plunger and said shielding section are configured such that, as said plunger is pushed, said shielding section, which is disposed on said plunger, is displaced so as to shield, in a fluid-tight manner, said fastening region on which said valve arrangement is attached by a valve mounting section, wherein said valve mounting section comprises an external valve-part.

19. The apparatus of claim 1, wherein said shielding section has an axial length that is selected such that, when said treatment head is coupled so that said valve arrangement is opened by advancing said plunger, a fluid-tight arrangement is formed with an external valve-part by way of which said valve arrangement is fastened in a valve mounting section.

* * * * *